United States Patent [19]

Uchida

[11] 4,220,495

[45] Sep. 2, 1980

[54] DEVICE FOR TRANSFERRING AN ADHESIVE FILM FROM A TRANSFERRING ADHESIVE TAPE ROLL TO AN ARTICLE

[76] Inventor: Hiromichi Uchida, Tokyo, Japan

[21] Appl. No.: 938,305

[22] Filed: Aug. 29, 1978

[30] Foreign Application Priority Data

Mar. 6, 1978 [JP] Japan ..... 53/28187[U]

[51] Int. Cl.[2] ..... B44C 7/00

[52] U.S. Cl. ..... 156/577; 156/584

[58] Field of Search ..... 156/574, 577, 584

[56] References Cited

U.S. PATENT DOCUMENTS

| | | | |
|---|---|---|---|
| 1,230,947 | 6/1917 | Thompson | 156/577 |
| 3,274,038 | 9/1966 | Karn | 156/584 |
| 3,861,988 | 1/1975 | Preisler | 156/584 |
| 3,969,181 | 7/1976 | Seabold | 156/584 |

FOREIGN PATENT DOCUMENTS

| | | | |
|---|---|---|---|
| 1326256 | 8/1973 | United Kingdom | 156/584 |

*Primary Examiner*—Douglas J. Drummond

*Attorney, Agent, or Firm*—Wenderoth, Lind & Ponack

[57] ABSTRACT

A device for automatically transferring an adhesive film having adhesive on both faces thereof from a roll of adhesive tape to an article. The device has a frame having a pair of support plates and a roll support shaft provided therebetween on which a roll of the adhesive tape is mounted, the tape roll including a rolled adhesive film having pressure sensitive adhesive on both faces thereof and a rolled removable spacer tape disposed between the adjacent turns of the adhesive film. The roll of adhesive tape is so arranged that the lower adhesive face protrudes beyond the lower edge of the frame. A device to feed the removed spacer tape out of the device is provided at the top of the frame. This feeding device can be a pair of pieces having an opening provided therebetween so as to guide the removed spacer tape out of the device after its removal from the adhesive film. The roll of adhesive tape is rollingly forced against an article so that the adhesive film is transferred to the article while the removable spacer tape is separated from the adhesive film and fed out of the device by the feeding out device.

4 Claims, 2 Drawing Figures

DEVICE FOR TRANSFERRING AN ADHESIVE FILM FROM A TRANSFERRING ADHESIVE TAPE ROLL TO AN ARTICLE

BACKGROUND OF THE INVENTION

A double sided adhesive tape has been used to close and adhere the flap of an envelope, for instance. Conventionally, a predetermined length of the adhesive tape is unwound from a tape roll, manually cut from the succeeding tape of the tape roll and then stuck to an article such as the envelope. The adhesive tape includes a rolled adhesive film having pressure-sensitive adhesive on both faces thereof and a removable spacer tape disposed between the adjacent turns of the adhesive film. After the adhesive tape is cut and stuck to the article, the removable spacer tape is separated from the adhesive film and then another adhesive face is exposed and used for closing and adhering the flap of the envelope, for instance. However, since the adhesive tape is manually cut, the operation is troublesome and it is also impossible to cut the tape in an orderly manner.

Of late, there has been proposed a device for transferring an adhesive film having adhesive on both faces thereof from a race of adhesive tape to an article. In the prior art, the device is constructed to be manually operated by means of an operating member such as a handle so as to forcefully transfer the adhesive film to the article while the removable spacer tape is separated from the adhesive film and wound on a bobbin. Thus, the device requires a manual operation, and therefore, the operation is still troublesome. Furthermore, the prior device requires a complicated construction including a tape roll support, tape pressurizing means and spacer tape winding means which are separately constructed. Thus, it is difficult to manufacture the device because many complicated members are required. It should be noted that the feeding speed of the adhesive tape and the winding speed of the removed spacer tape cannot be positively adjusted in such a manner as they are in accord. If they are not in accord, the tapes will be slackened or tightened, which causes the transfer of the adhesive film to be missed, or the spacer tape to be cut. In addition, if the removed spacer tape is slackened, the adhesive film will fail to be cut from the succeeding tape.

SUMMARY OF THE INVENTION

Accordingly, it is a principal object of the invention to provide a device for roll of an adhesive film from a transferring adhesive tape to an article wherein the operation can be more easily carried out.

It is another object of the invention to provide a device for roll of an adhesive film from a transferring adhesive tape to an article wherein the construction is more simplified and therefore more inexpensive.

It is further object of the invention to provide a device for roll of an adhesive film from a transferring adhesive tape to an article wherein the spacer tape is neither slackened nor tightened so that the adhesive film can be positively cut and stuck to the article.

In accordance with the invention, there is provided a device for transferring an adhesive film from a roll of adhesive tape to an article, comprising a frame having a roll support shaft; a roll of adhesive tape mounted on said roll support shaft and including a rolled adhesive film having pressure-sensitive adhesive on both faces thereof and a removable spacer tape disposed between the adjacent turns of said adhesive film, said adhesive tape roll being so arranged that its lower adhesive face protrudes from the lower edge of said frame; and means to feed said removable spacer tape out of said frame after it is separated from said adhesive film which is stuck to said article.

BRIEF DESCRIPTION OF THE DRAWINGS

The above and other objects and features of the invention will be apparent from the following description taken with reference to the accompanying drawings in which.

DETAILED DESCRIPTION OF THE EMBODIMENT

Figure 1:
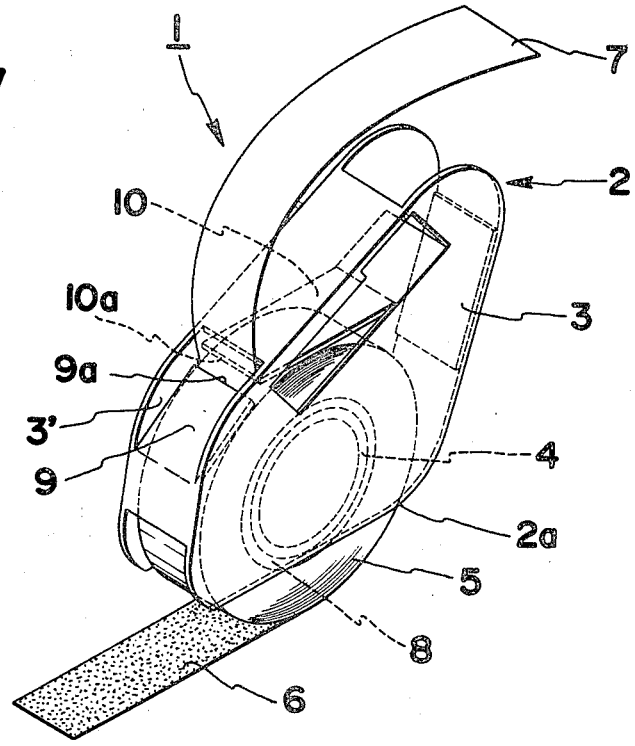
FIG. 1 is a perspective view of an adhesive tape transferring device constructed in accordance with the invention.
Figure 2:
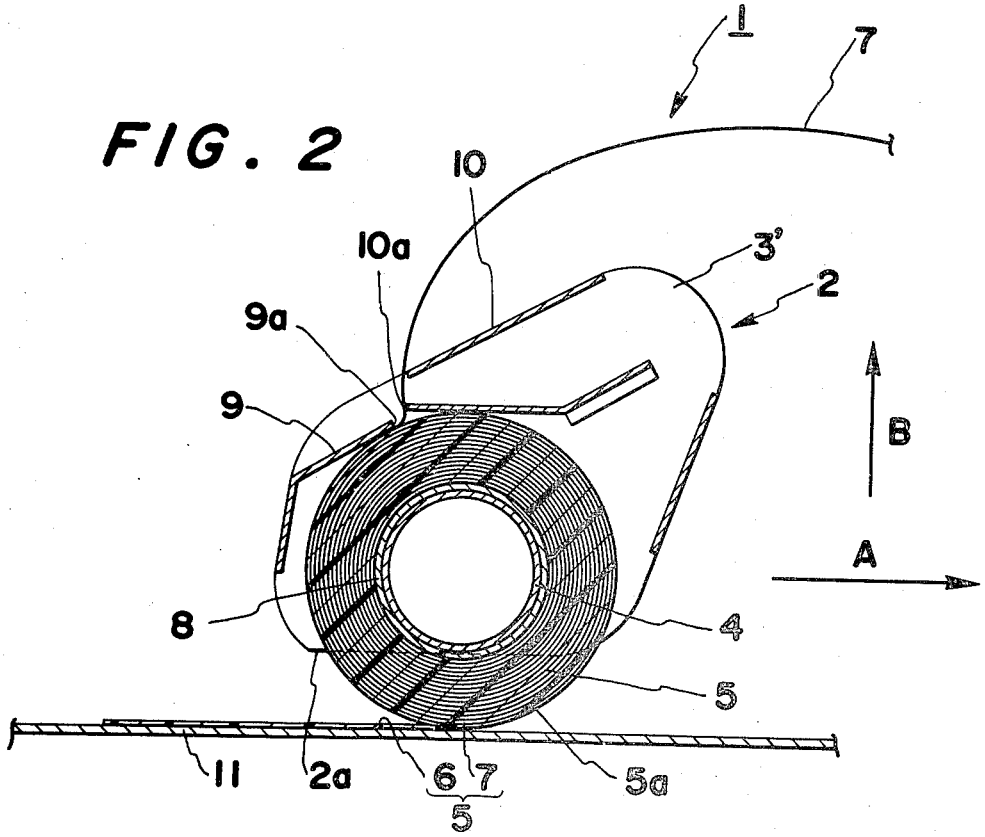
FIG. 2 is a vertical sectional view of the device of FIG. 1.
Figure 3:
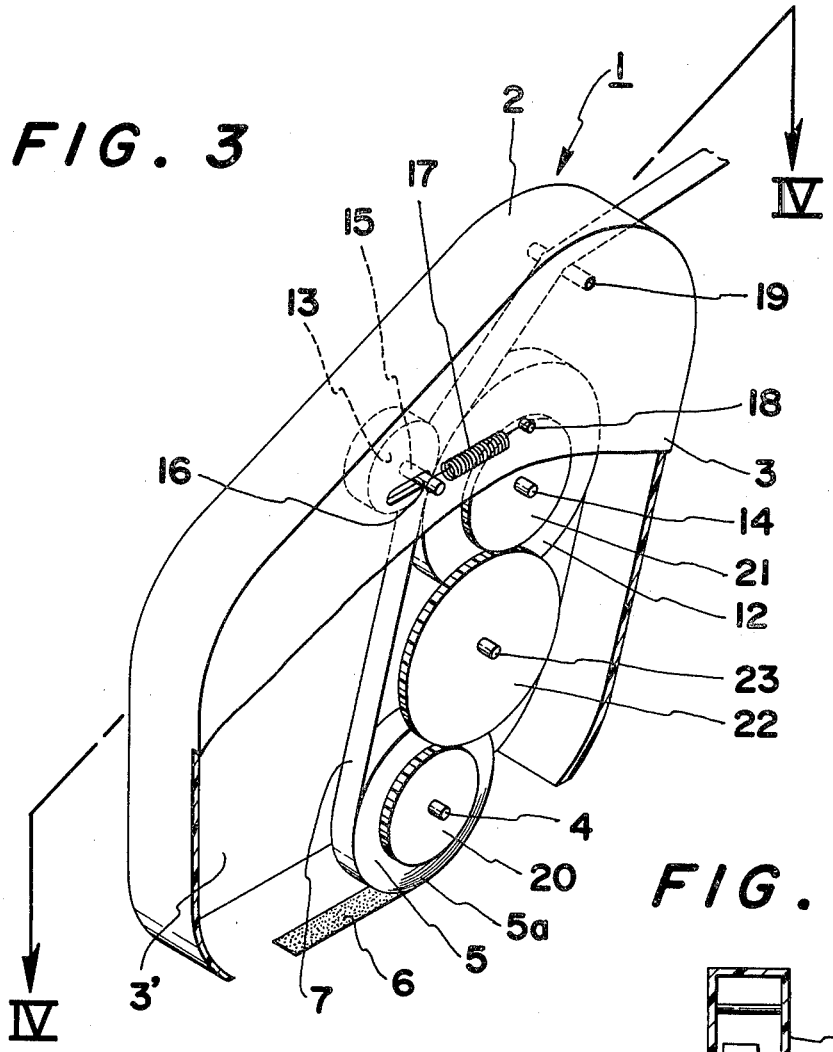
Figure 4:
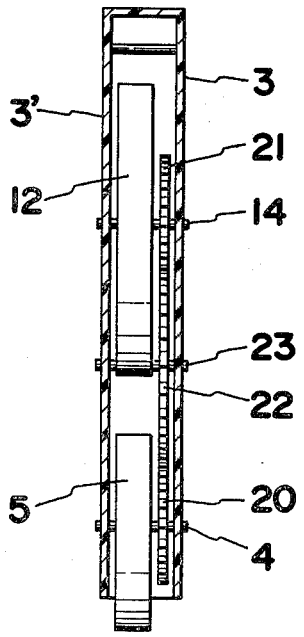
Figure 5:
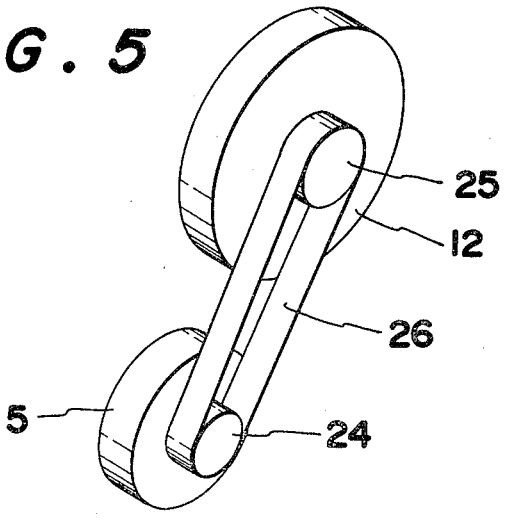

FIGS. 1 and 2 show the adhesive film transferring device 1 of the invention. This device comprises a frame 2 including a pair of support plates 3 and 3' of pasteboard, plastic or thin metal and a roll support shaft 4 provided between the pair of support plates 3 and 3'. If the device is the disposable type, the roll support shaft may be integrally mounted on the support plates 3 and 3'. Otherwise, the roll support shaft 4 may be mounted on either of the support plates 3 or 3' and the frame 2 is so constructed that the support plates 3 and 3' are separable from each other.

A roll 5 of adhesive tape includes a rolled adhesive film 6 having pressure-sensitive adhesive provided on both faces thereof and a slippery spacer tape 7 separable from the adhesive film 6. The adhesive tape roll 5 is mounted on the roll support shaft 4 as shown in FIGS. 1 and 2. As shown in FIG. 2, the tape roll 5 includes a bobbin 8 which is rotatable on the roll support shaft 4. This tape roll 5 is so arranged that the lower adhesive face 5*a* protrudes beyond the lower edge 2*a* of the frame 2. It will be noted that even after the tape roll 5 is substantially consumed, the lower adhesive face 5*a* should so protrude. Thus, the lower edge of the frame should be aligned with the lower face of the roll support shaft 4.

Means to feed the removable spacer tape 7 out of the frame 2 may comprise a pair of pieces 9 and 10 having respective leading edges 9*a* and 10*a* close to and spaced from each other. The pieces 9 and 10 are secured to and between the support plates 3 and 3' adjacent to the tops thereof. It should be noted that at least one of the pieces 9 and 10 resiliently engages the adhesive tape roll 5 so that the roll is prevented from being removed from the roll support shaft 4. The piece 9 may be preferably positioned at an angle tangent to the periphery of the tape roll 5 as shown in FIG. 2 so as to lead the spacer tape 7 out of the frame in a smooth manner. The piece 10 may be so arranged as to engage the back face of the spacer tape 7 and guide it out of the frame 2 without following the periphery of the tape roll 5.

In operation, the leading end of the adhesive tape is led out of the tape roll 5. The leading end of the adhesive film 6 is stuck to an article 11 such as a flap of an envelope while the leading end of the removed spacer tape 7 extends through the gap between the leading edges of the pieces 9 and 10 as shown in FIGS. 1 and 2. Thereafter, the operator rolls the device in a direction along the article 11 as indicated by the arrow A in FIG. 2 while he forces the device against the article 11. In this manner, the adhesive film 6 is continuously stuck to the article 11 while the spacer tape 7 is removed from the adhesive film 6 and led out of the frame 2. After a predetermined length of the adhesive film 6 is stuck to the article 11, the operator moves the whole device 1 in a direction away from the article 11 as indicated by the arrow B in FIG. 2. Thus, the stuck adhesive film 6 is cut from the succeeding adhesive tape of the roll 5 without removal from the article 11. If the support plates 3 and 3' are manually and forceably urged toward each other when the device is brought up, then the adhesive film 6 is cut in a smooth manner. It should be noted that the tape roll 5 serves as a transferring roller so as to forceably transfer the adhesive film 6 to the article 11 by application of pressure to the tape roll 5.

Although the feeding out roller 12 is adapted to be driven by the tape roll 5, it may be driven directly by or through slipping means by a micro electric motor (not shown) which is provided within the frame 2. Alternatively, the spacer tape 7 may be wound on a take up bobbin (not shown) which may be driven either by the tape roll 5 or by the micro electric motor in a manner as described in the foregoing.

While some preferred embodiments of the invention have been illustrated and described with reference to the accompanying drawings, it will be understood by those skilled in the art that they are by way of example, and that various modifications and changes may be made without departing from the spirit and scope of the invention, which is intended to be defined only by the appended claims.

What is claimed is:

1. A tape dispenser and tape package for transferring an adhesive film from a roll of adhesive tape to an article, consisting of a frame having a roll support shaft; a roll of adhesive tape rotatably mounted on said roll support shaft and having a rolled adhesive film having pressure-sensitive adhesive on both faces thereof and a rolled removable spacer tape disposed between the adjacent turns of said adhesive film, said transferring adhesive tape roll when mounted on said roll support shaft having the lowermost portion of the periphery thereof protruding beyond the lower edge of said frame; and means spaced around said frame from said lowermost portion for engaging only the spacer tape and separating it from the next inward turn of adhesive tape and feeding said removable spacer tape out of said frame after it is separated from said adhesive film which has stuck to an article and from the next underlying turn of adhesive tape.

2. A tape dispenser and tape package as claimed in claim 1, wherein said means to feed said removable spacer tape comprises a pair of pieces along the periphery of said frame having an opening therebetween extending parallel to said support shaft and through which said spacer tape is fed out of said frame as said roll of adhesive tape rotates.

3. A tape dispenser and tape package as claimed in claim 2, wherein at least one of said pair of pieces is mounted on said frame resiliently engaging said adhesive tape roll on said roll support shaft.

4. A tape dispenser for transferring an adhesive film from a roll of adhesive tape to an article, the roll having a rolled adhesive film with pressure sensitive adhesive on both faces thereof and a rolled removable spacer tape disposed between adjacent turns of said adhesive film, said dispenser consisting of a frame having a roll support shaft, the lower edge of said frame being aligned with the lowermost peripheral portion of said support shaft, and means spaced around said frame from said lowermost peripheral portion of said support shaft and positioned for engaging only the spacer tape and separating it from the next inward turn of adhesive tape and feeding removable spacer tape out of said frame after it has been separated from the adhesive film, whereby the roll of adhesive tape can be mounted on said roll support shaft and will protrude beyond the lowermost edge of said frame.

* * * * *